United States Patent [19]

Osborne

[11] Patent Number: 4,713,500

[45] Date of Patent: Dec. 15, 1987

[54] ELECTRIC BYPASS SWITCH

[75] Inventor: Anthony Osborne, Duluth, Ga.

[73] Assignee: Kearney-National, Inc., Atlanta, Ga.

[21] Appl. No.: 32,991

[22] Filed: Mar. 27, 1987

Related U.S. Application Data

[63] Continuation of Ser. No. 837,899, Mar. 10, 1986, abandoned.

[51] Int. Cl.[4] ..... H01H 9/26; H01H 31/10

[52] U.S. Cl. ..... 200/48 KB; 200/50 C; 200/282; 200/162; 200/254

[58] Field of Search ..... 200/153 S, 48 R, 254–256, 200/50 C, 15, 162, 243, 48 KB, 282

[56] References Cited

U.S. PATENT DOCUMENTS

| | | | |
|---|---|---|---|
| Re. 24,696 | 9/1959 | Steinmayer et al. | 200/50 C |
| 2,226,818 | 12/1940 | Heinrich | 200/162 |
| 2,809,244 | 10/1957 | Owens et al. | 200/50 C |
| 2,824,916 | 2/1958 | Steinmayer et al. | 200/50 C |
| 2,879,348 | 3/1959 | Ortwig | 200/50 C |
| 3,185,804 | 5/1965 | Howell | 200/162 |
| 3,255,322 | 6/1966 | Ball et al. | 200/48 R |
| 3,697,709 | 10/1972 | Witkor | 200/48 R |
| 3,991,293 | 11/1976 | Legeay et al. | 200/153 S |

*Primary Examiner*—Henry J. Recla
*Assistant Examiner*—Ernest G. Cusick
*Attorney, Agent, or Firm*—Rodgers & Rodgers

[57] ABSTRACT

An electric bypass switch for connecting and disconnecting an electric apparatus such as a voltage regulator with respect to a power system includes a pair of spaced insulators on each of which a pair of conductive terminals are mounted, one pair of terminals being adapted for connection to the apparatus and the other pair of terminals being adapted for connection with the infeed and outfeed conductors of an electric power line respectively, a pair of hinge contacts hingedly mounted respectively on one pair of the conductive terminals, a pair of jaw contacts mounted respectively on the other pair of conductive terminals, a unitary switch blade having a pair of concentric conductors which are separated by mechanically sturdy insulating material and arranged with the hinge ends thereof connected respectively with the hinge contacts and the swing ends of the switch blade conductors being engageable and disengageable with the jaw contacts respectively, a bypass conductor electrically connected with and pivotally mounted on one of the jaw contacts together with a pin mounted on a switch blade for disjointably engaging the bypass conductor for causing the bypass conductor to engage and disengage the other of the jaw contacts in coordination with opening and closing movement of the switch blade respectively.

9 Claims, 6 Drawing Figures

ELECTRIC BYPASS SWITCH

This is a continuation of application Ser. No. 837,899 filed Mar. 10, 1986, now abandoned.

TECHNICAL FIELD

This invention relates to bypass switches of the type which are adapted to connect and disconnect an electric apparatus such as a voltage regulator to and from a power system without interrupting the flow of power.

BACKGROUND ART

U.S. Pat. No. 2,879,348 issued Mar. 24, 1959 to a predecessor of the assignee of this invention discloses a bypass switch which includes a pair of switch blades mounted respectively on two pairs of insulators and wherein each switch includes a pair of parallel conductors together with special reinforcing members which bear the mechanical load involved in opening and closing of the switch blades. In addition, the switch blades are arranged so as to be movable individually for adapting themselves to the wear of the main switch contacts. While this patent constitutes an operable arrangement, it includes a number of parts which tend to increase the cost of the unit. Flow of current through switch blades of the type disclosed in U.S. Pat. No. 2,879,348 and other similar bypass switches results in relative transverse movement of the switch blades relative to each other due to the high magnitude of current which cause reorientation of the blades relative to each other and results in deleterious operation of the switch as a whole.

SUMMARY OF THE INVENTION

According to this invention in one form, a simplified and mechanically sturdy bypass switch is provided wherein a single switch blade includes a pair of conductors which are fixed in position relative to each other and separated by mechanically strong insultating material which prevents relative movement of the blade components. The apparatus which is to be connected and disconnected, in the form of the invention, is connected through suitable terminals with the hinge ends of the switch blade conductors respectively while the incoming and outgoing power lines are respectively connected to terminals each of which includes a pair of jaw contacts respectively engageable with the swing end of one of the conductors and a bypass switch movably mounted on one of the jaw contacts is arranged to engage and to disengage the other jaw contacts in coordination with opening and closing of said switch blade.

BEST MODE OF CARRYING OUT THE INVENTION

Figure 1:
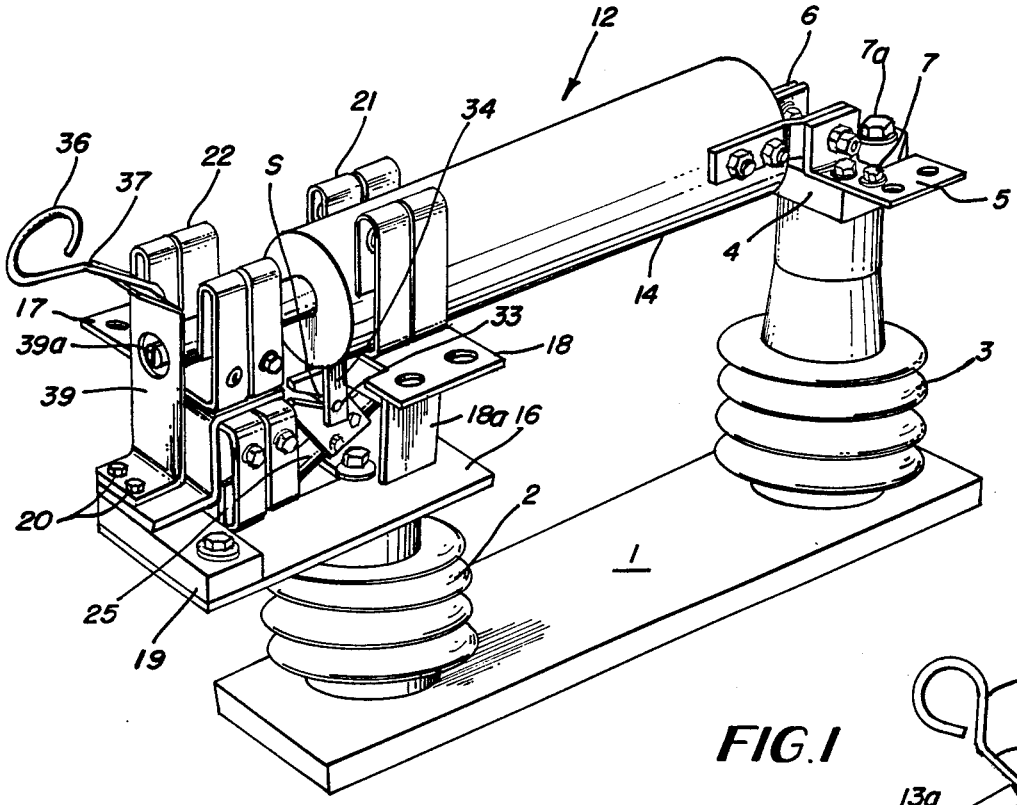
FIG. 1 is a perspective view of a bypass switch formed according to one form of this invention and shows the switch in closed condition.

In the drawings the numeral 1 represents a base structure shown as an elongated plate but which could take the form of a flanged metallic channel. A pair of electric insulators 2 and 3 are mounted on base 1. A supporting plate of insulating material designated by the numeral 4 is secured atop insulator 3 by suitable known means. A pair of laterally spaced conductive terminals 5 and 6 are secured to insulating plate 4 by suitable means such as bolts 7 and insulating plate 4 is secured to insulator 3 by bolts **7*a***.

Figure 2:
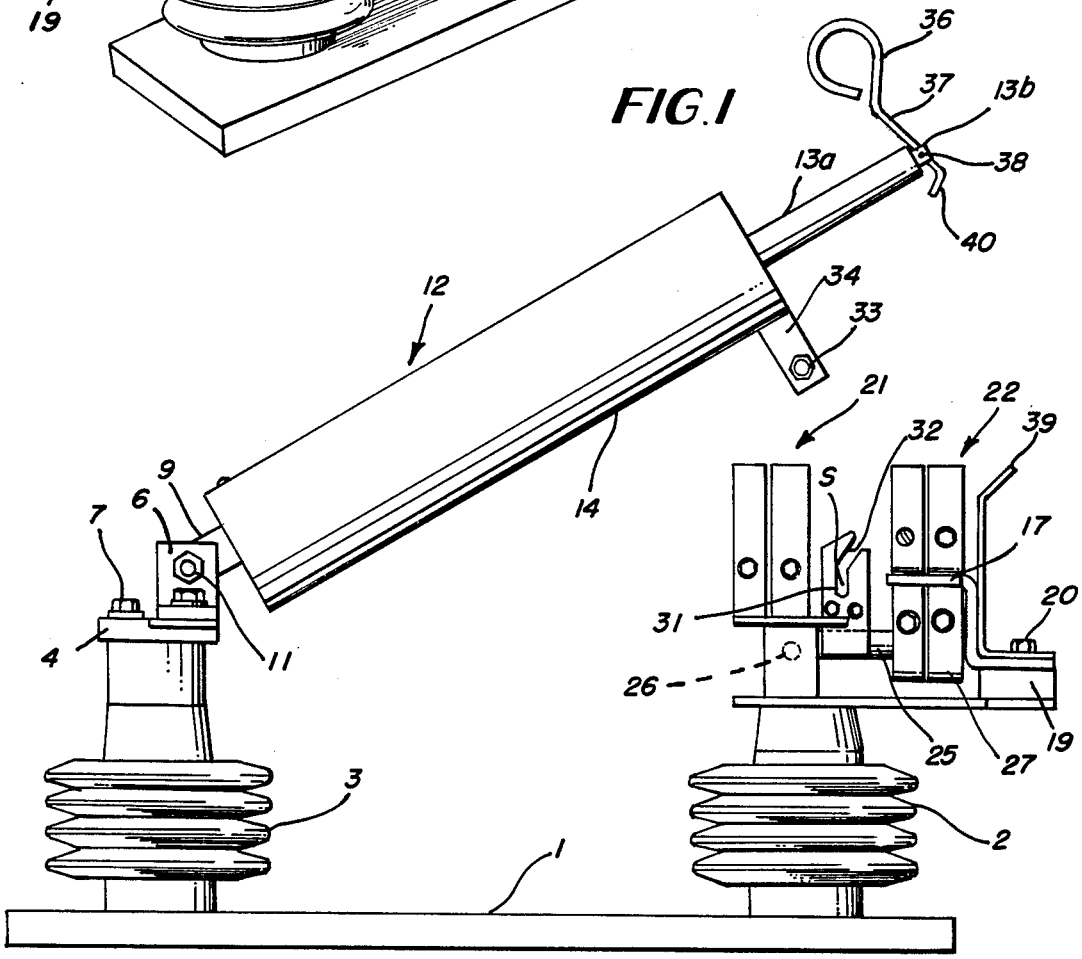
FIG. 2 is a side view of the switch shown in FIG. 1 and shows the switch in opened condition.

A pair of hinge contacts 8 and 9 are hingedly connected to terminals 5 and 6 respectively by hinge pins 10 and 11 respectively. This hinge structure provides means whereby the switch blade generally designated by the numeral 12 is mounted for opening and closing movement as represented by FIGS. 1 and 2 for example.

Figure 6:
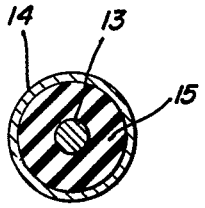
FIG. 5 is a view similar to FIG. 4 with parts broken away for simplicity and represents schematically the circuit with the bypass switch in opened condition and FIG. 6 is a cross sectional view taken along the line designated 6—6 in FIG. 4.
Figure 4:
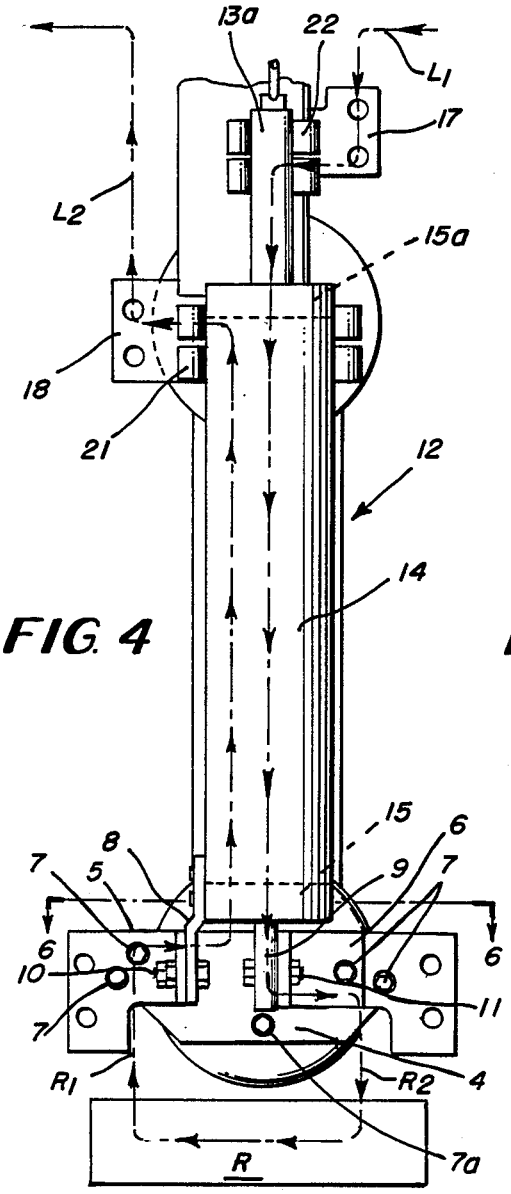
FIG. 4 is a schematic plan view of the bypass switch shown in FIGS. 1 and 2 and shows the switch in closed position.
Figure 5:
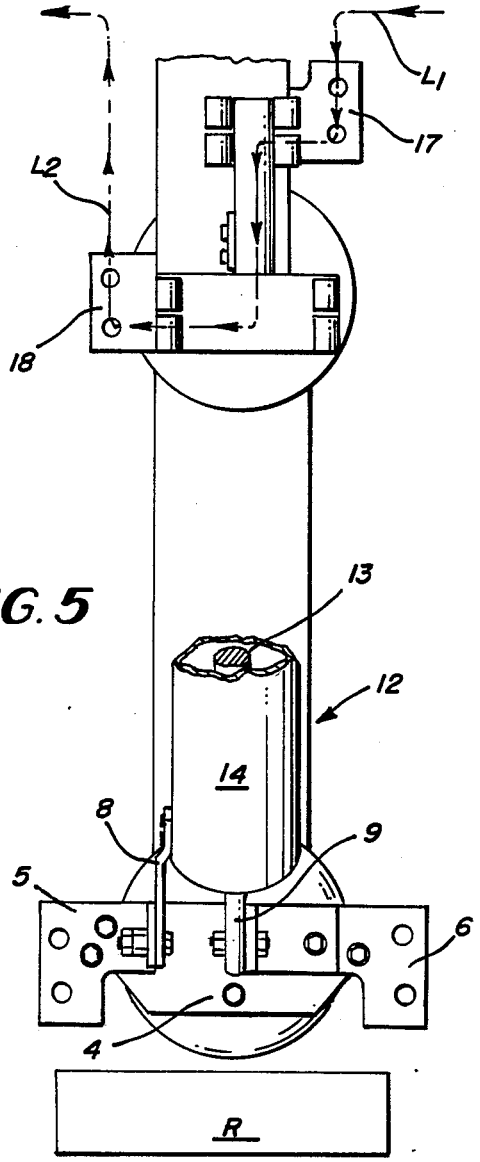

As is apparent from FIGS. 4, 5 and 6, the hinge contact 9 in reality constitutes an extension of inner conductor 13 which is concentrically disposed within the cylindrical shell 14, the conductors 13 and 14 being electrically and physically isolated from each other by insulating collars 15 and **15*a* which are formed of mechanically strong insulating material whereby relative shifting of conductors 13 and 14** is prevented in accordance with a feature of this invention.

The swing end of the switch blade 12 cooperates with the structure mounted on insulator 2 and such structure includes a plate 16 rigidly mounted stop insulator 2 by known means to which a vertical support **18*a* is welded. Terminal 18 is secured by suitable known means to vertical support 18*a*. Z shaped terminal 17 is mounted atop insulating pad 19 by bolts 20. Infeed power line such as L1 is connected with conductive terminal 17 while outgoing line L2 is connected electrically by known means with conductive terminal 18. Terminals 17 and 18** are laterally and longitudinally spaced apart.

Regulator R is arranged with its terminal R1 electrically connected with conductive terminal 5 and with its other terminal R2 electrically connected with conductive terminal 6 by suitable known means. Instead of a regulator, a transformer or other apparatus could be connected and disconnected if desired.

Jaw contacts 21 are mounted on terminal 18 while jaw contacts 22 are conductively mounted on terminal 17 as is apparent from the drawings. Extension **13*a* of center conductor 13 cooperates with jaw contacts 22 while concentrically arranged conductor 14 cooperates with jaw contacts 21**.

With the bypass switch in closed position as shown in FIGS. 1 and 4, electric current is deemed to enter the switch along infeed conductor L1 through jaw contacts 22, extension terminal **13*a* and conductor 13 through hinge contact 9, fixed terminal 6 through terminals R2 and R1 of regulator R thence to terminal 5 and hinge contact 8, cylindrical conductor 14, jaw contacts 21, terminal 18 and to outfeed line L2. Under these conditions with the switch blade 12** in closed position, the regulator R is in series with lines L1 and L2.

For servicing regulator R and for other purposes, it is necessary to remove the regulator from the circuit and to do so without interrupting the flow of current between power lines L1 and L2. Toward this end, an elongated bypass conductor 25 is pivotally mounted by means of pivot 26 to a conductive structure forming a part of vertical support 18*a* and cooperates with jaw contacts 27 which are electrically connected with terminal 17. Bypass conductor 25 is shown in its closed position in FIG. 3 by solid lines and in its open position by dotted lines.

The bypass conductor 25 includes a transverse projection 30 having a slot S therein which includes a first part 31 which is substantially normal to the major axis X—X' of bypass conductor 25 together with another part 32 which is disposed in angular relation to the first part 31.

Figure 3:
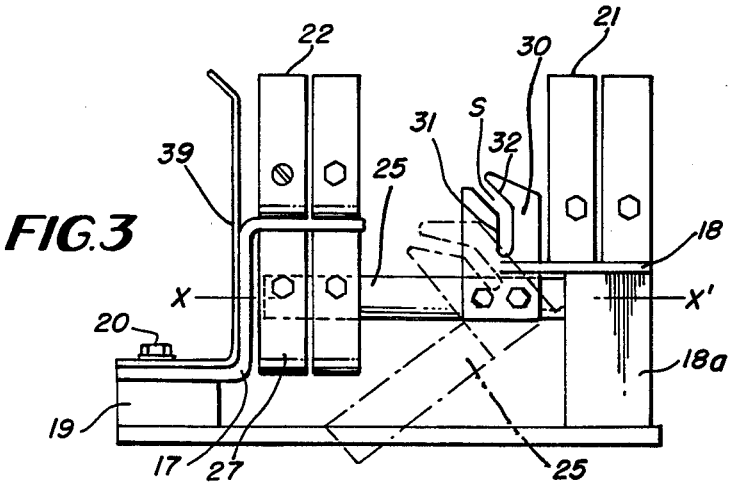
FIG. 3 is an enlarged view of the jaw contacts of the switch as viewed from the side.

With the switch blade 12 in closed position, a pin 33 mounted on a fixed projection 34 of concentric conductor 14 is disposed within the part 31 of the slot S formed in projection 30 and the bypass conductor 25 is disposed in the open position represented by dotted lines in FIG. 3.

By pass conductor 25 is arranged so that its swing end cooperates with jaw contacts 27 electrically connected with terminal 17.

When the apparatus such as regulator R is to be disconnected from the circuit without interrupting the flow of current along lines L1 and L2 it is simply necessary to open the switch blade 12. This is accomplished by means of a switch stick or other suitable apparatus for engaging the end 36 of operator element 37 provided at 38 to extension 13*a* of conductor 13. A suitable force imparted to ring 36 of operating element 37 causes the yieldable latch 39 to swing generally toward the left as viewed in FIG. 1 due to rotation of operating arm 37 in a clockwise direction as viewed in FIG. 1 to cause the projecting end 40 of operating arm 37 to engage yieldable plate 39 and thereby to allow the projecting end 13*b* of conductor 13*a* to move out of the aperture 39*a* formed in plate 39, thus releasing the switch blade 12 for opening movement. Continued opening movement of the switch blade 12 causes the pin 33 to ride upwardly in the portion 31 of the slot S to engage the portion 32 of slot S and thereby to rotate the bypass conductor 25 in a clockwise direction about pivot 26 as viewed for example in FIGS. 1 and 3. When the swing end of bypass conductor 25 engages the jaw contacts 27 the circuit as schematically represented in FIG. 5 is established. This condition is obtained prior to separation of contact 13*a* from jaw contacts 22 and separation of cylindrical concentric conductor 14 from the jaw contacts 21 so that an interchange of power between lines L1 and L2 continues without interruption while the regulator R is safely disconnected from the power system.

According to this invention, a composite switch blade is provided in which two conducting elements are rigidly affixed with respect to each other by means of mechanically strong insultating material which surrounds the inner one of a pair of concentric conductors and which is disposed within the outer one of such concentric conductors. Thus currents of large magnitude are prevented from imparting transverse movement of the concentrically arranged conductors and thereby to provide a switch which is precise in operation and which is reliable and sturdy and capable of minimum maintenance and long life.

I claim:

1. An electric by-pass switch comprising a pair of spaced insulators, a pair of conductive terminals mounted on each of said insulators and insulated from each other, one pair of said conductive terminals being laterally spaced and adapted for connection with two terminals respectively of an electric apparatus and the other pair of said conductive terminals being laterally and longitudinally spaced and adapted for connection with infeed and outfeed power conductors respectively, a pair of laterally spaced hinge contacts hingedly mounted respectively on said one pair of said conductive terminals, a pair of longitudinally spaced jaw contacts mounted respectively on the other pair of said conductive terminals, conductive structure connected with one of said jaw contacts, a unitary rigid switch blade having a pair of concentric conductors comprising an inner conductor and an outer conductor fixed in position relative to each other and separated by mechanically strong insulating material therebetween, each concentric conductor having two ends, the inner conductor of said concentric conductors projecting outwardly from each end of the outer one of said concentric conductors, corresponding ends of said pair of concentric conductors being pivotally secured to said hinge contacts respectively and the opposite ends of said pair of concentric conductors being engageable and disengageable with said jaw contacts respectively, a bypass conductor electrically connected with and movably mounted on said conductive structure, and means mounted on said switch blade for disjointably engaging said by-pass conductor for causing said bypass conductor to engage and to disengage the other of said jaw contacts.

2. An electric bypass switch according to claim 1 wherein said bypass switch comprises an elongated part having a major axes and an integral transverse projection fixedly mounted on said bypass conductor and having a slot therein for engaging and disengaging a part of said switch blade.

3. An electric bypass switch according to claim 2 wherein said slot includes a first part which is substantially normal to the major axis of said bypass conductor and a second part which is in angular relation to said first part.

4. An electric bypass switch according to claim 2 wherein a pin is fixedly mounted on said switch blade for engaging and disengaging said slot.

5. An electric bypass switch according to claim 1 wherein said jaw contacts are spaced apart and located in an imaginary plane in which said switchblade is movable.

6. An electric bypass switch according to claim 1 wherein the inner one of said concentric conductors engages and disengages one of said jaw contacts which is more remote from said hinge contacts that the other of said jaw contacts.

7. An electric bypass switch according to claim 1 wherein said electric apparatus is connected with said one pair of conductive terminals on which said hinge contacts are mounted respectively.

8. An electric bypass switch according to claim 1 wherein said bypass conductor is pivotally mounted on a conductor connected with said one jaw contact.

9. An electric by-pass switch comprising a pair of spaced insulators, a pair of conductive terminals mounted on each of said insulators and insulated from each other, one pair of said conductive terminals being laterally spaced and adapted for connection with two terminals respectively of an electric apparatus and the other pair of said conductive terminals being laterally and longitudinally spaced and adapted for connection with infeed and outfeed power conductors respectively, a pair of laterally spaced hinge contacts hingedly mounted respectively on said one pair of said conductive terminals, a pair of longitudinally spaced jaw contacts mounted respectively on the other pair of said conductive terminals, conductive structure connected with one of said jaw contacts, a unitary rigid switch blade having a pair of concentric conductors comprising an inner conductor and an outer conductor fixed in position relative to each other and separated by mechanically strong insulating material therebetween, each concentric conductor having two ends, the inner conductor of said concentric conductors projecting outwardly from each end of the outer one of said concentric conductors, corresponding ends of said pair of concentric conductors being pivotally secured to said hinge contacts respectively and the opposite ends of said pair of concentric conductors being engageable and disengageable with said jaw contacts respectively, and an elongated by-pass conductor having a major axis and being electrically connected with and movably mounted on said conductive structure and having a transverse projection fixedly mounted on said by-pass conductor and having a slot therein for engaging and disengaging a part of said switch blade.

* * * * *